United States Patent [19]

Bowling

[11] 4,251,066

[45] Feb. 17, 1981

[54] VISE

[76] Inventor: Carlton L. Bowling, P.O. Box 1501, Huntsville, Tex. 77340

[21] Appl. No.: 908,517

[22] Filed: May 22, 1978

Related U.S. Application Data

[63] Continuation of Ser. No. 790,991, Apr. 26, 1977, abandoned.

[51] Int. Cl.[3] ..... B25B 1/24

[52] U.S. Cl. ..... 269/283

[58] Field of Search ..... 269/279–284, 269/296; 308/3 A, 3 R

[56] References Cited

U.S. PATENT DOCUMENTS

| | | | |
|---|---|---|---|
| 1,307,050 | 6/1919 | Hohnsheen | 269/281 |
| 1,550,751 | 8/1925 | Sinkler | 269/283 |
| 2,490,843 | 12/1949 | Sordi | 269/296 |
| 2,609,717 | 9/1952 | Maroth | 269/282 |
| 2,653,499 | 9/1953 | Partiss | 269/280 |
| 3,368,808 | 2/1968 | Worthington | 269/279 |
| 3,575,435 | 4/1971 | Lemanski | 269/281 |

FOREIGN PATENT DOCUMENTS

| | | | |
|---|---|---|---|
| 325439 | 9/1920 | Fed. Rep. of Germany | 308/3 A |

*Primary Examiner*—Robert C. Watson
*Attorney, Agent, or Firm*—Marvin B. Eickenroht; Jennings B. Thompson

[57] ABSTRACT

There is disclosed a vise for use in a vertical milling machine or the like wherein the inner sides of master jaws releasably attached to the inner sides of the locking jaws of the vise are provided with dovetail grooves in which dovetails on the outer side of soft jaws or hard jaws may be releasably clamped.

17 Claims, 6 Drawing Figures

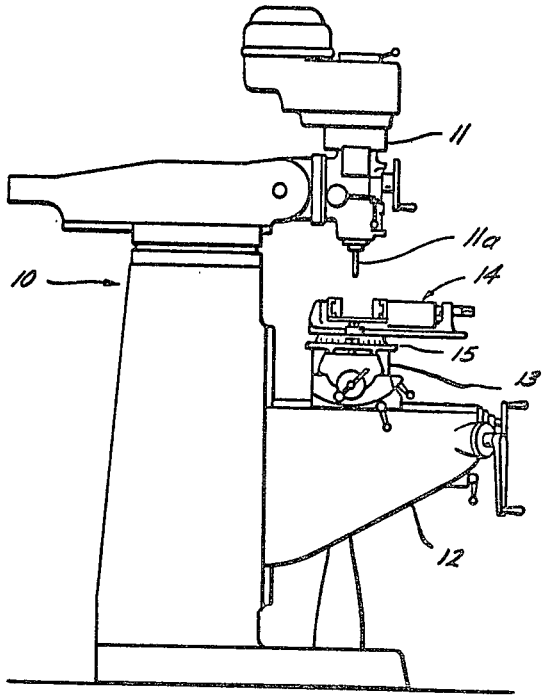
FIG. 1
FIG. 2
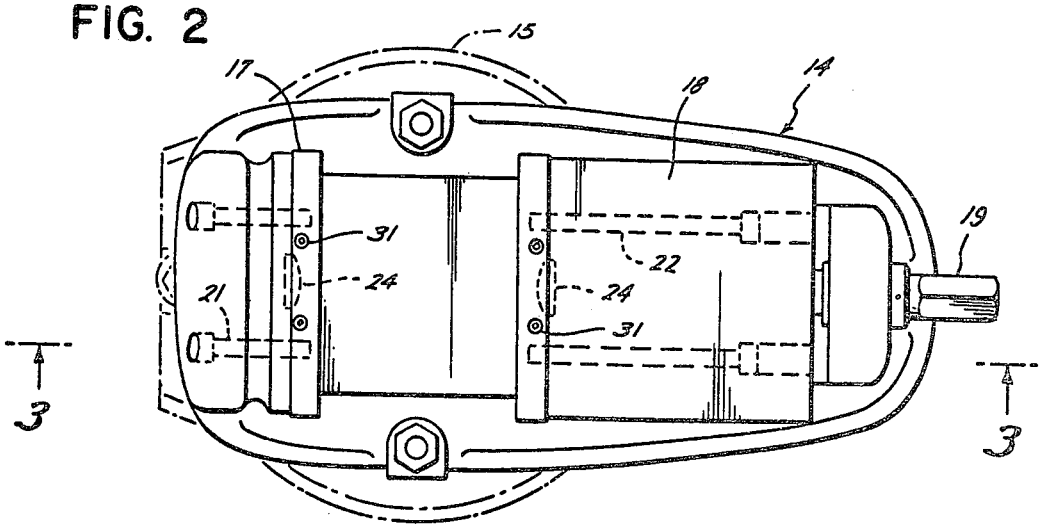
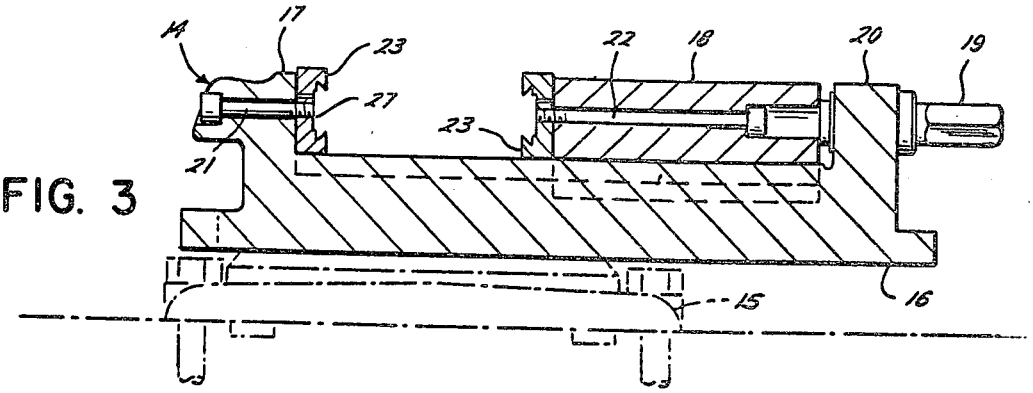
FIG. 3

VISE

This is a continuation of application Ser. No. 790,991, filed Apr. 26, 1977, by Carlton L. Bowling now abandoned.

This invention relates generally to improvements in vises for use in vertical milling machines or the like wherein a workpiece is adapted to be held between soft jaws releasably attached to the inner sides of the locking jaws of the vise.

In vises of this type, jaws of relatively hard metal, and known in the art as "hard jaws", are releasably attached to the inner sides of the relatively movable locking jaws of the vise by bolts or the like. In the event a particular workpiece is shorter than the space between the hard jaws, it may be necessary to mount it between jaws of relatively soft metal, and known in the art as "soft jaws", whose inner sides may be machined to a shape for receiving the workpiece in a desired position on the milling machine.

For this purpose, it has been the practice to replace the hard jaws with the soft jaws, which requires that each soft jaw be prepared for attachment to a locking jaw in the same manner that the hard jaw is attached thereto. Since the attachment is by bolts, this requires that, at the very least, two holes be drilled in each soft jaw, and, in some cases, that the holes be tapped. Also, the soft jaws are generally provided in a standard length, which may be greater than is required to mount the particular workpiece, thereby resulting in considerable wastage of the soft jaw material.

An object of this invention is to provide a vise of this type in which the soft jaws are less expensive, in that they do not require this elaborate preparation, and in which they may be releasably attached to the locking jaws with less time and effort.

Another object is to provide such a vise in which the soft jaws need not be provided in standard lengths, but instead may be cut from stock to the length required to mount a particular workpiece.

A further object is to provide a vise of this type which may be used to mount the soft jaws in position to be machined for receiving a workpiece.

Still another object is to provide an attachment for converting an existing vise of this type to a vise adapted to accomplish one or more of the above noted objects.

These and other objects are accomplished, in accordance with the illustrated embodiment of the present invention, by a vise in which each locking jaw has means providing a dovetail groove along its inner side for receiving a dovetail of approximately the same cross-section on the outer side of a soft jaw. More particularly, a means is provided for moving the oppositely facing tapers toward and away from one another, and thus toward and away from the corresponding tapers on the dovetail, for releasably attaching the soft jaw to the locking jaw. Preferably, this movement is accomplished by a weakened section, such as a slot, extending along the base of the groove intermediate the tapers, and a means such as one or more pins connecting the tapers on opposite sides of the weakened section for movement toward and away from one another. In any event, however, the only preparation necessary for attaching the soft jaws to the locking jaws is the provision of the dovetail along the back side thereof, and since the dovetail and its groove are of uniform cross-section, the soft jaws may be cut from a common length of stock, and thus only to the length required for holding a particular workpiece.

In its preferred embodiment, this invention provides an attachment for an existing vise of this type, wherein the dovetail grooves are formed in a pair of master jaws which are provided as replacements for the existing hard jaws. In this case, of course, the master jaws would be prepared for attachment to the locking jaws in the same way that the existing hard jaws are prepared therefor. However, the invention also contemplates that the grooves may be formed in the locking jaws of the vise as manufactured.

Preferably, a pair of hard jaws are also provided each having a dovetail one one side thereof of approximately the same cross-section as the dovetail groove on the inner side of each master jaw. A groove on the other side thereof has a base and taper which cooperate with the base and taper of a groove on the other hard jaw to form the opposite sides of a dovetail groove therebetween, so that the hard jaws may be releasably attached to the master jaws for receiving the opposite sides of a dovetail of a soft jaw between them in a position to be machined to receive a workpiece. More particularly, the opposite sides of this groove are of approximately the same cross-section as the dovetail grooves formed on the inner sides of the master jaw, so that the hard jaws may be used to prepare the soft jaws to be attached to such master jaws. Since the master jaws remain attached to the locking jaws during both preparation of the soft jaws and their subsequent connection to the hard jaws, the dovetails and grooves insure accurate placement of the recess prepared therein for holding the workpiece.

In the drawings, wherein like reference characters are used throughout to designate like parts:

FIG. 1 is a side view of a vertical milling machine having a vise thereon constructed in accordance with the present invention; FIG. 2 is an enlarged top plan view of the vise; FIG. 3 is a longitudinal sectional view of the vise, as seen along broken lines 3—3 of FIG. 2;

Figure 4:
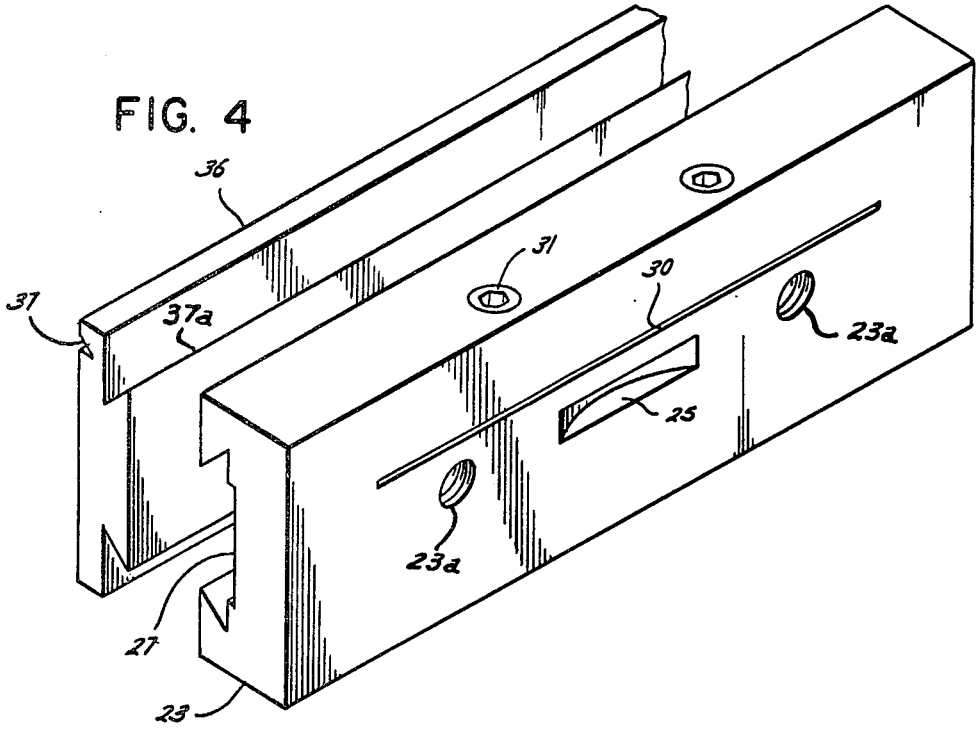
FIG. 4 is an enlarged perspective view of one of the master jaws and a hard jaw adapted to be releasably attached thereto.

With reference now to the details of the above-described drawings, the vertical milling machine shown in FIG. 1, and indicated in its entirety by reference character 10, includes a head 11 having a spindle 11*a* mounted thereon above a knee 12. A table 13 is mounted on the knee to support the above-described vise 14 in position to hold a workpiece beneath a suitable milling tool on the spindle 11*a*. More particularly, the vise is mounted on a swivel 15 (shown in broken lines in FIGS. 2 and 3) secured to the table to permit the workpiece to be moved into a desired rotative position relative to the tool on the spindle.

As best shown in FIGS. 2 and 3, the vise 14 includes an elongate base 16 having a fixed locking jaw 17 at one end thereof, and a movable locking jaw 18 slidably mounted on the top of the base 16 for movement toward and away from locking jaw 17 by means of a lead screw 19 mounted on a flange on the end of base 16 opposite jaw 17. In a vertical milling machine having a vise of this type, which is made and sold by Bridgeport Machines, Inc., of Bridgeport, Conn., and illustrated in that company's Catalog BR 64, a hard jaw (not shown) is releasably attached to the inner end of each locking jaw. For this purpose, a pair of bolts 21 extend through the locking jaw 17 for threaded connection to a tapped hole in one hard jaw, and a pair of bolts 22 extend through the locking jaw 18 for threaded connection to a tapped hole in the other hard jaw.

In accordance with the illustrated embodiment of the present invention, the existing hard jaws are replaced by an attachment including a pair of master jaws 23, each of which is made of a relatively hard metal and prepared with a pair of tapped holes 23*a* for threaded connection to the inner ends of the bolts 21 and 22. As shown in the drawings, when the master jaws are so attached to the locking jaws, their outer sides are flush with the inner sides of the locking jaws and their lower ends fit snugly against the top of the base 16 of the vise. In order to insure that the master jaws are maintained in this position, even though the connection of the bolts thereto might become loose, a key 24 extends between aligned slots 25 and 26 in the outer side of each master jaw and inner side of each locking jaw, respectively.

Figure 6:
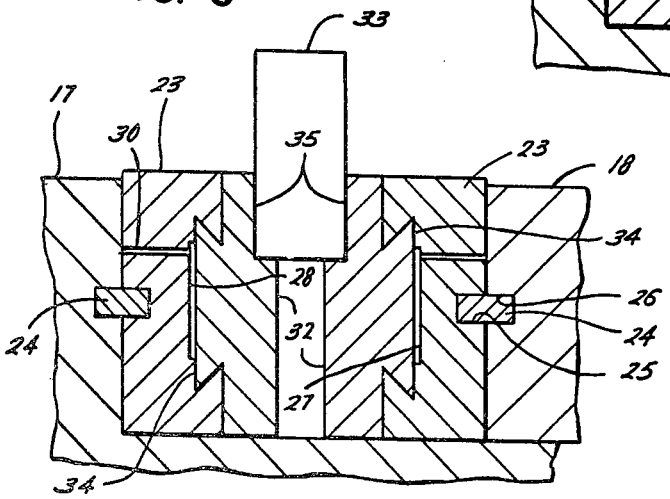
FIG. 6 is another cross-sectional view of the vise with the soft jaws attached to the master jaws, and a workpiece received between them in position to have work performed thereon.

A dovetail groove 27 extending across the inner side of each master jaw has a base 28 and a pair of oppositely facing tapers 29 which converge outwardly from the base. As shown in FIG. 6, a soft jaw 32 is releasably attached to each master jaw 23 by means of a dovetail 34 extending across its outer side and of approximately the same cross-section as the dovetail groove 27 in the master jaw so as to slidably fit therein. When the soft jaws are so attached, they are adapted to hold a workpiece therebetween, as will be described to follow.

Figure 5:
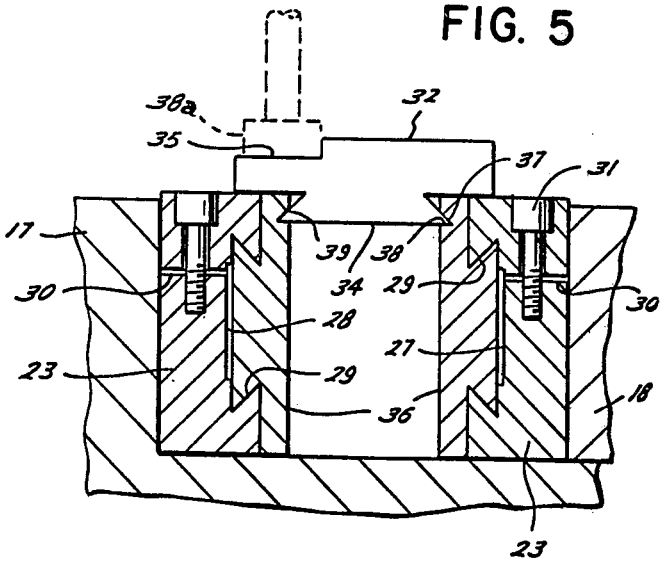
FIG. 5 is a cross-sectional view of the vise with the hard jaws attached to the master jaws, and a soft jaw received between the hard jaws during machining of its upper side.

Each dovetail groove 27 has a slot 30 extending along its base to provide a weakened section in the master jaw intermediate the upper and lower tapers of the groove. As shown in FIG. 4, this slot extends for a major portion of the length of the groove above the bolt holes 23*a* and key slot 25, and the portions of the master jaw on opposite sides of the slot 30 are connected by a pair of screws 31 which extend through holes in the upper portion to threadedly connect with the lower portion, as shown in FIG. 5. The upper ends of the screws are enlarged so that turning of the screws in one direction will narrow the slot to draw the portions of the master jaw toward one another, and thus clamp the soft jaw therebetween, while turning of the screws in the opposite direction will permit the slots to return to their normal widths, and thus permit the portions of each master jaw to move away from one another, so as to permit the soft jaw to be inserted or removed.

As illustrated in FIG. 6, when the soft jaws are so attached, their outer sides above and below the dovetails 34 thereon fit flush against the inner sides of the master jaws above and below the dovetail groove 27 therein. The soft jaws and master jaws are of substantially the same height, with dovetail 34 on each soft jaw 32 being symmetrical top-for-bottom and dovetail groove 27 in each master jaw being somewhat closer to its upper end than to its lower end. Thus, the lower ends of the soft jaws are close to but spaced slightly above the top of the base of the vise, and the upper ends thereof are just above the upper ends of the master jaws 23. In this way, it is possible to reverse the positions of the soft jaws top-for-bottom and thereby use both their upper and lower ends for holding a workpiece. As also shown in FIG. 6, the base 28 of each dovetail groove is relieved intermediate its upper and lower ends so as to concentrate the load between the dovetails on the soft jaws and the dovetail grooves in the master jaws to relatively small areas.

As illustrated, the inner sides and grooves of both master jaws are identical and of uniform cross-section, so that both soft jaws may be cut from a common length of stock of relatively soft material, such as aluminum. Due to the fact that the cross-section is uniform, it may be extruded; and, since the soft jaws are cut from the stock, each need only be of a length required to hold the workpiece 33.

The inner side of each soft jaw adjacent the upper corner thereof is provided with a machined recess 35 for tightly engaging the adjacent side of the workpiece 33. As will be apparent, the inner sides of the soft jaws are moved into tight engagement with the workpiece 33 by movement of the locking jaw 18 toward the fixed jaw 17 by means of the feed screw 19.

As shown in FIG. 5, the attachment of the present invention also includes a pair of hard jaws 36 made of a relatively hard metal similar to the master jaws 23. The outer side of each hard jaw 36 has a dovetail 37*a* thereon of a cross-section approximately the same as the cross-section of the dovetail 34 of the soft jaws 32, so that the hard jaws 36 may be releasably attached to the master jaws 23 in the same manner as the soft jaws 32. Also, the hard jaws are of generally the same height as the soft jaws, and arranged symmetrically top-for-bottom of the hard jaw so that their lower ends are spaced slightly above the top of the base 16 of the groove, and their upper ends are just above the upper end of the master jaws 23.

The inner side of each hard jaw 36 has a groove 37 formed therein near its upper corner which includes a base 38 and a taper 39. More particularly, the grooves 37 of both hard jaws are similarly located and generally of the same cross-section, so that when the hard jaws are attached to the master jaws, the grooves 37 form the opposite sides of an upwardly converging dovetail groove. More particularly, the grooves 37 are of the same cross-section as the opposite sides of the dovetail grooves 27 in the master jaws, so as to receive the dovetail of a soft jaw 32 therebetween which is to be attached to one of the master jaws 23.

Thus, the lower side of the soft jaw 32 shown in FIG. 5, which becomes the outer side thereof upon attachment to the master jaw, will fit flush against the upper ends of the hard jaws and master jaws when the opposite sides of its dovetail are releasably fitted within the grooves 37 in the hard jaws. As will be apparent, the soft jaw is so mounted upon movement of the movable locking jaw toward the fixed locking jaw so as to bring the grooves 37 into tight fitting relation over the opposite sides of the dovetail 34. With the soft jaw 32 so held, a suitable milling tool 38*a* on the lower end of the spindle 12 of the milling maching may be moved into position for machining a recess 35 on the upper side of the soft jaw, which becomes the inner side thereof, when the soft jaw is mounted within the master jaw. More particularly, inasmuch as the vise is mounted on the swivel 15, it may be turned to a position in which a milling tool may be used to cut a recess therein on a diagonal with respect to the outer edges of the soft jaw.

In any event, upon preparation of a pair of soft jaws in the manner illustrated in FIG. 5, the hard jaws may be detached from the master jaws, in the manner previously described, and the prepared soft jaws releasably attached to the master jaws, again as previously described. At this time, this vise is ready for movement into the position of FIG. 6, for holding a workpiece 33 in place between the recesses 35 machined thereon.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. For use in a vertical milling machine or the like, a vise, comprising a pair of locking jaws each having a means providing a dovetail groove extending along its inner side, each groove having a base and a pair of oppositely facing tapers, each groove-providing means also having a slot extending longitudinally along the base of the groove therein, but terminating short of its ends, and means connecting the tapers on opposite sides of the slot for movement toward and away from one another.

2. A vise of the character defined in claim 1, wherein the connecting means comprises at least one screw threadedly connecting said tapers.

3. For use in a vertical milling machine or the like, a vise, comprising a pair of master jaws each having means providing a dovetail groove extending along its inner side, each groove having a base and a pair of oppositely facing tapers and being of the same cross-section, and a length of stock which is formed in its entirety of a material which is softer than that of which the groove is formed and which has a dovetail along one side thereof of approximately the same cross-section as the dovetail grooves, said stock being free of holes or other means of attachment to the groove other than the dovetail and being at least several times as long as each groove, so that the stock is adapted to be cut into soft jaws each of which is releasably fitted in a groove on a locking jaw to dispose the inner sides of the soft jaws in position to receive a workpiece therebetween.

4. For use in a vertical milling machine or the like, a vice, comprising a pair of locking jaws each having means providing a dovetail groove extending along its inner side, each groove having a base and a pair of oppositely facing tapers, and a pair of hard jaws each having a dovetail along one side thereof for releasably fitting within the groove on one of said locking jaws, the opposite side of each hard jaw having a groove extending therealong, and the groove in each hard jaw having a base and a taper cooperable with the groove of the other hard jaw to form the opposite sides of a dovetail groove when the dovetails of the hard jaws are fitted within the grooves of the locking jaws.

5. A vise of the character defined in claim 4, including a length of stock which is formed in its entirety of a material which is softer than that of which the groove is formed and which has a dovetail along one side thereof whose opposite sides are of approximately the same cross-section as the opposite sides of the groove formed by said hard jaws, said stock being free of holes or other means of attachment to the groove other than the dovetail and being at least several times as long as each groove so that the stock is adapted to be cut into soft jaws which are releasably fitted within said opposite sides.

6. A vise of the character defined in claim 5, wherein the opposite sides of the grooves on the locking jaws are of the same cross-section as those formed by the hard jaws, so that, upon removal of the hard jaws from the grooves on the locking jaws, the dovetails of the soft jaw cut from the stock and others like it are adapted to be releasably fitted therein.

7. A vise of the character defined in claim 4, including a jaw having a dovetail whose opposite sides are of approximately the same cross-section as the opposite sides of the groove formed by the hard jaws, so that the dovetail of said jaw is adapted to be releasably fitted therein, each jaw being formed in its entirety of a material which is softer than that of which the grooves are formed.

8. A vise of the character defined in claim 7, wherein the opposite sides of the groove on the locking jaws are of the same cross-section as those formed by the hard jaws, so that, upon removal of the hard jaws therefrom, the dovetails of the soft jaws and others like it are adapted to be releasably fitted therein.

9. An attachment for a vise adapted to be used in a vertical milling machine or the like, said attachment comprising a pair of master jaws each having means thereon for releasably attaching one side thereof to the inner side of one locking jaw of the vise and a dovetail groove extending along its opposite side, each groove having a base and a pair of oppositely facing tapers, and each master jaw also having a slot extending longitudinally along the base of the groove therein, and means connecting portions of each master jaw on opposite sides of the slot for moving the tapers of the groove toward and away from one another.

10. An attachment of the character defined in claim 9, wherein the connecting means comprises at least one screw threadedly connecting said master jaw portions.

11. An attachment for a vise adapted to be used in a vertical milling machine or the like, said attachment comprising a pair of master jaws each having means thereon for releasably attaching one side thereof to the inner side of one locking jaw of the vise and a dovetail groove extending along its opposite side, each groove having a base and a pair of oppositely facing tapers and being of the same cross-section, and a length of stock which is formed in its entirety of a material which is softer than that of which the groove is formed and which has a dovetail along one side thereof of approximately the same cross-section as the dovetail grooves, said stock being free of holes or other means of attachment to the groove other than the dovetail, so that the stock is adapted to be cut into soft jaws each of which is releasably fitted in a groove of a master jaw to dispose the inner sides of the soft jaws in position to receive a workpiece therebetween.

12. An attachment for a vise adapted to be used in a vertical milling machine or the like, said attachment comprising a pair of master jaws each having means thereon for releasably attaching one side thereof to the inner side of one locking jaw of the vise and a dovetail groove extending along its opposite side, each groove having a base and a pair of oppositely facing tapers, and a pair of soft jaws each having a dovetail along one side thereof for releasably fitting within a groove of a master jaw to dispose the opposite sides of the soft jaws in position to receive a workpiece therebetween, each soft jaw being formed in its entirety of a material which is softer than that of which the groove in the master jaw is formed.

13. An attachment for a vise adapted to be used in a vertical milling machine or the like, said attachment comprising a pair of master jaws each having means thereon for releasably attaching one side thereof to the inner side of one locking jaw of the vise and a dovetail groove extending along its opposite side, each groove having a base and a pair of oppositely facing tapers, and a pair of hard jaws each having a dovetail along one side thereof for releasably fitting within the groove of one of said master jaws, the opposite side of each hard jaw having a groove extending therealong, and each hard jaw groove having a base and a taper cooperable with the groove of the other hard jaw to form the opposite sides of a dovetail groove when the dovetails of the hard jaws are fitted within the grooves of the master jaws.

14. An attachment of the character defined in claim 13, including a length of stock which is formed in its entirety of a material which is softer than that of which the groove is formed and which has a dovetail along one side thereof whose opposite sides are of approximately the same cross-section as the opposite sides of the groove formed by said hard jaws, said stock being free of holes or other means of attachment to the groove other than the dovetail and being at least several times as long as each groove, so that the stock is adapted to be cut into soft jaws which are releasably fitted within said opposite sides.

15. An attachment of the character defined in claim 14, wherein the opposite sides of the grooves in the master jaws are of the same cross-section as those formed by the hard jaws, so that, upon removal of the hard jaws from the master jaws, the dovetails of the soft jaw cut from the stock and others like it are adapted to be releasably fitted therein.

16. An attachment of the character defined in claim 13, including a soft jaw having a dovetail whose opposite sides are of approximately the same cross-section as the opposite sides of the groove formed by the hard jaws, so that the dovetails of said soft jaw are adapted to be releasably fitted therein, each soft jaw being formed in its entirety of a material which is softer than that of which the grooves are formed.

17. An attachment of the character defined in claim 16, wherein the opposite sides of the grooves in the master jaws are of the same cross-section as those formed by the hard jaws, so that, upon removal of the hard jaws therefrom, the dovetails of said soft jaw and others like it are adapted to be releasably fitted in the grooves of the master jaws.

* * * * *